United States Patent [19]

Yoshimura et al.

[11] Patent Number: 4,682,904

[45] Date of Patent: Jul. 28, 1987

[54] PAPER FEED MECHANISM FOR PRINTER

[75] Inventors: Masato Yoshimura; Ryouhei Ohsaki, both of Tokyo, Japan

[73] Assignee: Oki Electric Industry Co., Ltd., Tokyo, Japan

[21] Appl. No.: 758,075

[22] Filed: Jul. 23, 1985

[30] Foreign Application Priority Data

Jul. 23, 1984 [JP] Japan ..... 59-110277[U]

[51] Int. Cl.[4] ..... B41J 11/30

[52] U.S. Cl. ..... 400/616; 400/616.2; 226/74

[58] Field of Search ..... 400/613.2, 616, 616.1, 400/616.2, 616.3; 226/74, 76

[56] References Cited

U.S. PATENT DOCUMENTS

| | | | |
|---|---|---|---|
| 2,080,524 | 5/1937 | Allen | 400/616.2 |
| 3,552,739 | 1/1971 | Roberts et al. . | |
| 4,160,606 | 7/1979 | Caenazzo | 400/616.2 |
| 4,213,551 | 7/1980 | Windele | 400/616.2 X |
| 4,453,660 | 6/1984 | Cornell et al. | 226/74 |
| 4,569,468 | 2/1986 | Neer | 400/616.1 X |
| 4,569,610 | 2/1986 | Drejza et al. | 400/616.3 X |

*Primary Examiner*—Edgar S. Burr
*Assistant Examiner*—J. R. McDaniel

[57] ABSTRACT

A paper feed mechanism for use in a printer has a pin tractor unit disposed on one side of a platen which is opposite to a print head, and a paper guide plate located below the pin tractor unit. The pin tractor unit has an endless tractor belt trained around a plurality of pulleys to form a first guide passage above the pin tractor unit and a second guide passage inclined from the first guide downwardly toward a position beneath the platen. The tractor belt has pins for fitting into perforations defined in the side margins of continuous paper. The continuous paper is inserted between the pin tractor unit and the paper guide plate, threaded between the platen and the print head, and then extended along the first guide passage. By moving the tractor belt in a prescribed direction, the continuous paper can be pulled by the pin tractor unit so as to be fed along in one direction. Alternatively, the continuous paper is guided along the first and second guide passages or the second guide passage only, and then the tractor belt is moved in a direction opposite to the above prescribed direction to advance the leading end of the paper between the platen and the paper guide plate and then between the platen and the print head. The continuous paper can now be pushed by the pin tractor unit so as to be fed along in an opposite direction.

4 Claims, 4 Drawing Figures

PAPER FEED MECHANISM FOR PRINTER

BACKGROUND OF THE INVENTION

The present invention relates to a paper feed machanism for use in a printer.

Some printers use fanfold stacks or continuous sheets as printing mediums, the fanfold paper having perforations defined at regular intervals in side margins thereof for feeding the paper at an accurate and constant rate. The printer for use with the fanfold paper is equipped with a pin wheel unit or a pin tractor unit having pins for fitting in the perforations to feed the paper.

The conventional feed machanisms employing such pin wheel units and pin tractor units for feeding the sheets between the platen and the print head of the printer are largely classified into a paper-pulling system for feeding the paper by pulling the same and a paper-pushing system for feeding the paper by pushing the same.

When one of the feed systems is to be changed to the other feed system on a printer, however, the pin wheel unit or the pin tractor unit is required to be replaced or to be changed in position, a process which the operator is called upon to carry out manually. Therefore, the operator is subject to an extra expenditure of time and labor.

SUMMARY OF THE INVENTION

It is an object of the present invention to provide a paper feed mechanism which can be converted between a paper-pulling system and a paper-pushing system without reguiring the pin wheel or tractor unit to be replaced or changed in position.

To accomplish the above object, a pin tractor unit is disposed on one side of a platen which is opposite to a print head, and a paper guide plate is located below the pin tractor unit, the paper guide plate having an end portion extending along an outer circumferential surface of the platen toward a position close to the print head. The pin tractor unit has a tractor belt trained around a plurality of pulleys to form a first guide passage above the pin tractor unit and a second guide passage inclined from the first guide downwardly toward a position beneath the platen.

Continuous paper is inserted between the pin tractor unit and the paper guide plate, threaded between the platen and the print head, and then extended along the first guide passage. By moving the tractor belt in a prescribed direction, the continuous paper can be fed along in a paper-pulling system. Alternatively, the continuous paper is guided along the first and second guide passages or the second guide passage only, and then the tractor belt is moved in a direction opposite to the above prescribed direction to advance the leading end of the paper between the platen and the paper guide plate and then betwen the platen and the print head. The continuous paper can now be fed along in a paper-pushing system.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
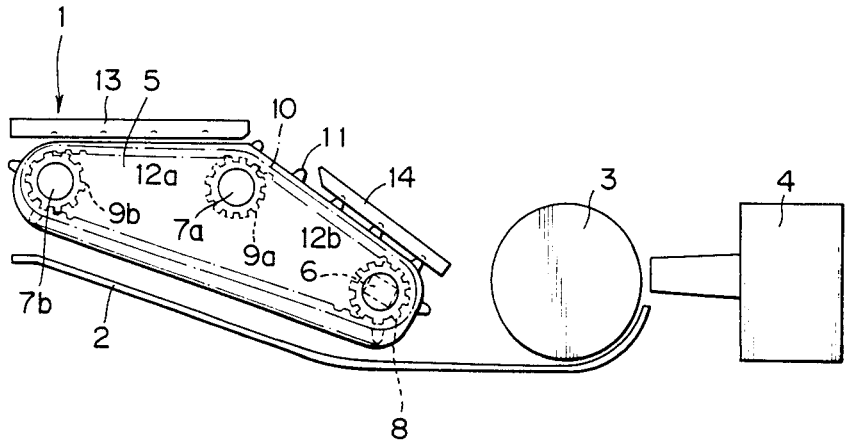
FIG. 1 is a schematic side elevational view of a paper feed mechanism according to the present invention.

FIG. 1 shows a paper feed mechanism according to the present invention. The paper feed mechanism is composed of a pin tractor unit 1 and a paper guide plate 2. A printer in which the paper feed mechanism is incorporated has a platen 3 and a print head 4 having a tip end disposed in confronting relation to the platen with a certain clearance therebetween.

The pin tractor unit 1 is disposed on one side of the platen 3 which is opposite to the print head 4. The pin tractor unit 1 has a tractor frame 5 through which a drive shaft 6 and support shafts 7*a*, 7*b* extend. A toothed drive pulley 8 is mounted on the drive shaft 6 for driving an endless tractor belt 10. The support shafts 7*a*, 7*b* support toothed idler pulleys 9*a*, 9*b*, respectively, which engage the tractor belt 10. The toothed pulley 8 is fitted axially slidably over the drive shaft 6 having a rectangular cross section, and is rotatable in one direction or the other when the drive shaft is rotated about its own axis.

The endless tractor belt 10 has a plurality of pins 11 formed on its outer peripheral surface at constant intervals for feeding continuous paper, and teeth formed on its inner peripheral surface and held in mesh with the toothed pulleys 8, 9*a*, 9*b*. The tractor belt 10 is trained around the toothed pulleys 8, 9*a*, 9*b* to form a first guide passage 12*a* extending between the toothed idler pulleys 9*a*, 9*b* and a second guide passage 12*b* extending between the toothed pulleys 8, 9*a* and inclined from the first guide passage 12*a* toward a position beneath the platen 3.

The first guide passage 12*a* is covered with a first cover 13 swingably attached to the tractor frame 5 so as to open and close the first guide passage 12*a*. The second guide passage 12*b* is covered with a second cover 14 fixed to the tractor frame 5.

The paper guide plate 2 is disposed below the pin tractor unit 1 and has one end portion extending along an outer circumferential surface of the platen 3 toward a position close to the tip end of the print head 4.

Two pin tractor units 1 each of the foregoing construction are used as a pair and positioned in alignment with side margins of continuous paper or fanfold paper which have perforations defined at regular intervals.

Operation of the paper feed mechanism will be described with reference to FIGS. 2 through 4.

Figure 2:
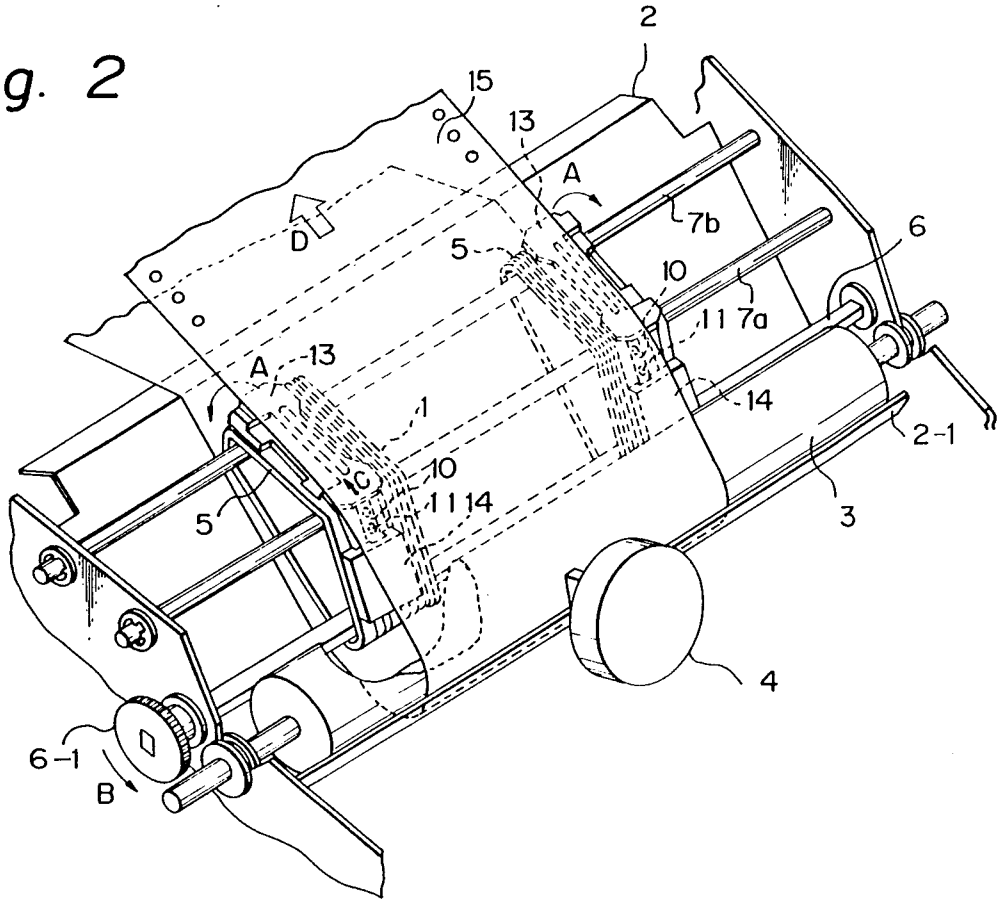
FIG. 2 is a fragmentary perspective view of a printer in which the paper feed mechanism of FIG. 1 is employed to feed continuous paper in a paper-pulling system.

FIG. 2 shows a printer incorporating the paper feed mechanism for feeding the continuous paper in a paper-pulling system. The continuous paper, denoted at 15, has perforations in which the pins 11 of the tractor belt 10 can fit and which are spaced at intervals equal to the pitches of the pins 11. The toothed pulleys 8, 9*a*, 9*b* are concealed from view as they are disposed in the tractor frame 5.

The continuous paper 15 is set in position by being inserted between the pin tractor unit 1 and the paper guide plate 2, and passed between the platen 3 and the print head 4, with the pins 11 of the tractor belt 10 in the first guide passage 12*a* being fitted in the perforations in the continuous paper 15 wound around the platen 3. The continuous paper 15 can easily be set in place by lifting the first cover 13 upwardly in the direction of the arrow A to open the first guide passage 12*a*. After the continuous paper 15 is mounted, the first cover 13 is closed to keep the pins 11 fitted in the perforations in the continuous paper 15.

The toothed pulley 8 is now rotated in the direction of the arrow B by the drive shaft 6 and a gear 6-1 mounted on an end of the drive shaft 6 and operatively coupled to a drive source (not shown). The tractor belt 10 is caused to run in the direction of the arrow C for thereby pulling the continuous paper 15 with the perforations fitted over the pins 11 of the tractor belt 10. The continuous paper 15 is fed along between the platen 3 and the print head in the direction of the arrow D.

Figure 3:
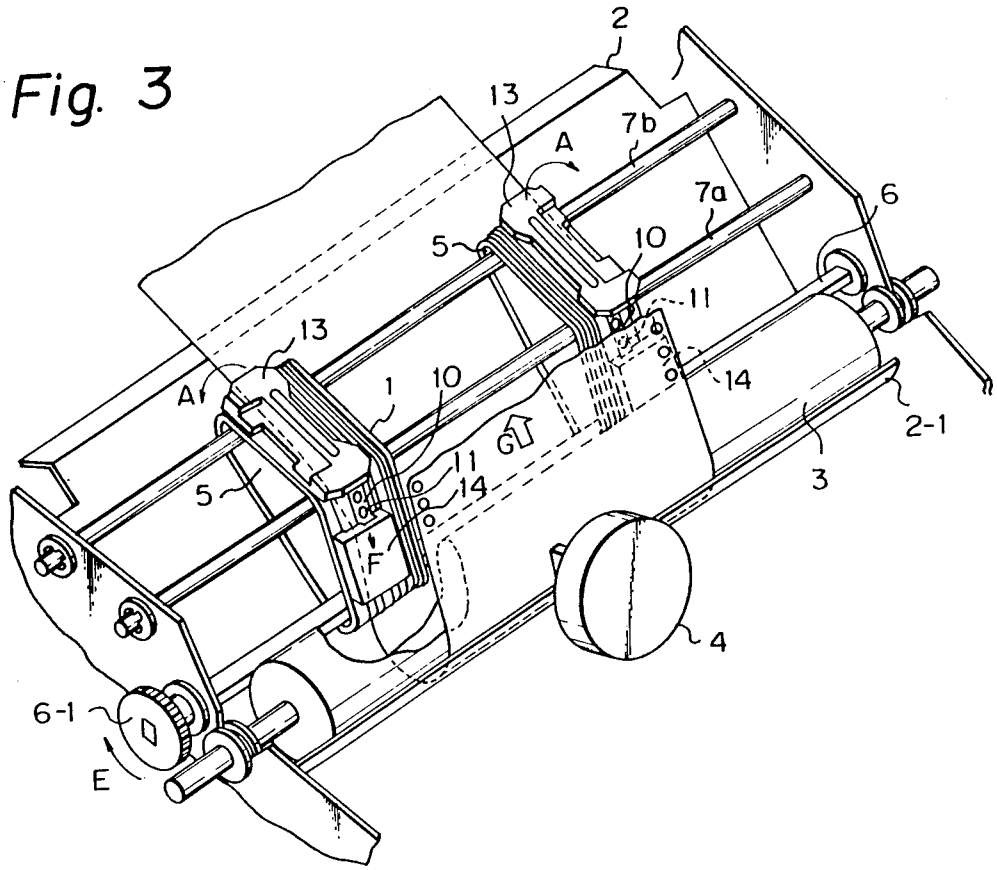
FIG. 3 is a fragmentary perspective view of the printer in which the paper feed mechanism of FIG. 1 is employed to feed continuous paper in a paper-pushing system.

FIG. 3 shows a paper-pushing system for feeding the continuous paper by pushing the same.

To set the continuous paper in the paper pushing system, the first cover 13 is opened in the direction of the arrow A, and the perforations in the continuous paper 15 are fitted over the pins 11 of the tractor belt 10 in the first guide passage 12*a*, followed by closing the first cover 13. While guiding the leading end of the continuous paper 15 to enter between the second cover 14 and the tractor belt 10, the toothed pulley 8 (FIG. 1) is rotated in the direction of the arrow E which is opposite to the direction of the arrow B (FIG. 2) by the drive source through the gear 6-1 and the drive shaft 6, thereby moving the tractor belt 10 in the direction of the arrow F. As the tractor belt 10 travels in the direction of the arrow F, the leading end of the continuous paper 15 moves through the second guide passage 12*b*, leaves the tractor belt 10 at the lower end of the second guide passage 12*b*, and then enter between the platen 3 and the paper guide plate 2. Since the end 2-1 of the paper guide plate 2 is positioned along the outer circumferential surface of the platen 3 and closely to the tip end of the print head 4, the leading end of the continuous paper 15 can be fed along the paper guide plate 2 and passed between the platen 3 and the print head 4 by further moving the tractor belt 10 in the direction of the arrow F. Continued movement of the tractor belt 10 causes the continuous paper 15 to be fed in the direction of the arrow G between the platen 3 and the print head 4.

Figure 4:
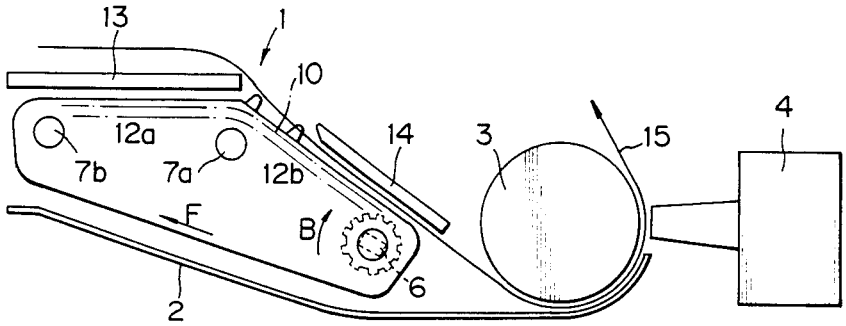
FIG. 4 is a schematic side elevational view showing another paper-pushing system for feeding continuous paper.

FIG. 4 illustrates another paper-pushing system using the paper feed mechanism of the invention for feeding the continous paper. In the paper-pushing system of FIG. 4, the continuous paper 15 is guided from above the first cover 13 and the leading end thereof is positioned between the second guide passage 12*b* and the second cover 14. Then, the tractor belt 10 is driven in the direction of the arrow F to feed the continuous paper 15, which is passed between the platen 3 and the print head 4.

With the present invention, therefore, the continuous paper can be fed along in either the paper-pulling system or the paper-pushing system simply by passing the continuous paper 15 selectively in different paths.

Since the paper-pulling system or the paper-pushing system can easily be selected on the same paper feed mechanism without replacing the pin tractor unit or changing the position of the pin tractor unit, the paper feed mechanism of the invention can free the operator of an extra expenditure of time and labor which would otherwise be required for switching between the paper-pulling system and the paper-pushing system.

Although a certain preferred embodiment has been shown and described, it should be understood that many changes and modifications may be made therein without departing from the scope of the appended claims.

What is claimed is:

1. A paper feed mechanism for feeding continuous paper having perforations defined at equal intervals in each of side margins thereof, comprising:

(a) a pin tractor unit having an upper side and a lower side opposite to and below said upper side, said pin tractor unit including a toothed drive pulley and toothed idler pulleys and an endless tractor belt trained around said toothed pulleys, said belt having a plurality of pins projecting on an outer peripheral surface of said belt for fitting in the perforations in the continuous paper, and teeth formed on an inner peripheral surface of said belt and held in meshing engagement with said toothed pulleys;

(b) a platen rotatable about its own axis;

(c) a print head disposed adjacent to said platen on one side of said platen, said pin tractor unit being positioned on an other side of said platen opposite said one side;

(d) a paper guide plate disposed below and opposing said lower side of said pin tractor unit and having an end portion extending along an outer circumferential surface of said platen;

(e) said tractor belt trained around said toothed pulleys having a first guide passage on said upper side above said pin tractor unit and a second guide passage on said upper side inclined downwardly from said first guide passage toward a position beneath said platen; and (f) means for rotating said toothed drive pulley selectively in one direction or the other, whereby the continuous paper can be fed in a first direction in a path successively between said paper guide and said pin tractor unit, around said platen, and through said first guide passage with said pins fitting in the perforations in the continuous paper along said first guide passage, by rotating said toothed drive pulley in said one direction, and can be fed in a second direction in a path successively through said second guide passage with said pins fitting in the perforations in the continuous paper along said second guide passage, and around said platen, by rotating said toothed drive pulley in said other direction.

2. A paper feed mechanism according to claim 1, wherein said pin tractor unit includes a tractor frame, a first cover pivotally mounted on said tractor frame for openably covering said first guide passage, and a second cover fixedly mounted on said tractor frame for covering said second guide passage.

3. A paper feed mechanism according to claim 1, wherein said end portion of said paper guide plate extends to a position close to said print head.

4. A paper feed mechanism according to claim 1, wherein a first one of said toothed pulleys separates said first guide passage from said second guide passage, a second one of said toothed pulleys being located below said first one of said toothed pulleys, between said platen and said first one of said toothed pulleys and along an inclination extending from said first one of said toothed pulleys to said position beneath said platen, and second guide passage extending from said first one of said toothed pulleys to said second one of said toothed pulleys, said first guide passage extending from a third one of said toothed pulleys to said second one of said toothed pulleys.

* * * * *